US007656092B2

(12) United States Patent
Yim et al.

(10) Patent No.: US 7,656,092 B2
(45) Date of Patent: Feb. 2, 2010

(54) MICRO DISCHARGE (MD) PLASMA DISPLAY PANEL (PDP) HAVING PERFORATED HOLES ON BOTH DIELECTRIC AND ELECTRODE LAYERS

(75) Inventors: Sanghoon Yim, Yongin-si (KR); Yoonchang Kim, Yongin-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 8 days.

(21) Appl. No.: 11/516,035

(22) Filed: Sep. 6, 2006

(65) Prior Publication Data

US 2007/0052359 A1 Mar. 8, 2007

(30) Foreign Application Priority Data

Sep. 7, 2005 (KR) ..... 10-2005-0083109

(51) Int. Cl.
*H01J 17/06* (2006.01)

(52) U.S. Cl. ..... 313/618; 313/631; 313/582

(58) Field of Classification Search ..... None
See application file for complete search history.

(56) References Cited

U.S. PATENT DOCUMENTS 3,956,667 A * 5/1976 Veith ..... 345/72
4,112,329 A * 9/1978 Veith ..... 313/491
4,340,838 A * 7/1982 Kobale et al. ..... 313/348
5,541,618 A 7/1996 Shinoda
5,661,500 A 8/1997 Shinoda et al.

(Continued)

FOREIGN PATENT DOCUMENTS

EP 1 017 081 7/2000

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Toan Ton
*Assistant Examiner*—Britt D Hanley
(74) *Attorney, Agent, or Firm*—Robert E. Bushnell, Esq.

(57) ABSTRACT

A Plasma Display Panel (PDP) includes a dielectric layer having a plurality of dielectric-layer perforated holes arranged in a matrix; upper and lower electrode layers each having electrode-layer perforated holes connected to the dielectric-layer perforated holes and arranged on both surfaces of the dielectric layer, the upper and lower electrode layers being adapted to receive electrical signals. The upper electrode layer includes a plurality of upper electrodes extending in a first direction, each of the plurality of upper electrodes surrounding a group of the electrode-layer perforated holes arranged in the first direction and including transparent individual electrodes surrounding the electrode-layer perforated holes and linear connection portions adapted to electrically connect the individual electrodes. The lower electrode layer includes a plurality of lower electrodes extending in a second direction at an angle with respect to the first direction, each of the plurality of second electrodes surrounding a group of electrode-layer perforated holes arranged in the second direction.

18 Claims, 5 Drawing Sheets

U.S. PATENT DOCUMENTS

| | | | | |
|---|---|---|---|---|
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,069,446 | A | 5/2000 | Kim | |
| RE37,444 | E | 11/2001 | Kanazawa | |
| 6,612,889 | B1 * | 9/2003 | Green et al. | 445/24 |
| 6,630,916 | B1 | 10/2003 | Shinoda | |
| 6,707,436 | B2 | 3/2004 | Setoguchi et al. | |
| 2002/0167275 | A1 * | 11/2002 | Bechtel et al. | 313/587 |
| 2003/0230983 | A1 | 12/2003 | Vonallmen | |
| 2007/0210709 | A1 | 9/2007 | Yim et al. | |

FOREIGN PATENT DOCUMENTS

| | | |
|---|---|---|
| FR | 2 265 172 | 10/1975 |
| JP | 2845183 | 10/1998 |
| JP | 2917279 | 4/1999 |
| JP | 2001-043804 | 2/2001 |
| JP | 2001-325888 | 11/2001 |
| KR | 10-2001-0046925 | 6/2001 |
| KR | 10-2003-0064168 | 7/2003 |
| KR | 10-2003-0092611 | 12/2003 |
| KR | 10-2003-0092612 | 12/2003 |
| KR | 10-2004-0010465 | 1/2004 |

* cited by examiner

MICRO DISCHARGE (MD) PLASMA DISPLAY PANEL (PDP) HAVING PERFORATED HOLES ON BOTH DIELECTRIC AND ELECTRODE LAYERS

CLAIM OF PRIORITY

This application makes reference to, incorporates the same herein, and claims all benefits accruing under 35 U.S.C. § 119 from an application for PLASMA DISPLAY PANEL OF MICRO DISCHARGE TYPE, earlier filed in the Korean Intellectual Property Office on the 7 Sep. 2005 and there duly assigned Serial No. 10-2005-0083109.

BACKGROUND OF THE INVENTION

1. Field of the Invention

The present invention relates to a Plasma Display Panel (PDP), and more particularly, to a Micro Discharge (MD) PDP, which includes a dielectric layer having a plurality of dielectric-layer perforated holes arranged in a matrix and electrode layers provided on the upper and lower surfaces of the dielectric layer and having a plurality of electrode-layer perforated holes corresponding to the dielectric-layer perforated holes.

2. Description of Related Art

In general, a Plasma Display Panel (PDP) is formed by forming barrier ribs and electrodes on two substrates spaced apart from each other and facing each other, injecting discharge gas therebetween and sealing the two substrates.

In the PDP, numerous pixels are regularly arranged in a matrix. In the PDP, the pixels are driven by supplying voltages to the electrodes without an active element, that is, a passive matrix arrangement. The PDP is classified into a DC PDP and an AC PDP, depending on a voltage signal for driving the electrodes. Alternatively, the PDP is classified into a face discharge PDP and a surface discharge PDP, depending on the arrangement of two electrodes to which a discharge voltage is supplied.

A surface light emitting source using a plasma discharge includes a Micro Discharge (MD) and a Micro Hollow Cathode Discharge (MHCD).

There are various types of MD PDPs, but an open MD PDP has been chosen for illustrative purposes. The MD PDP is composed of three layers: upper and lower electrode layers for receiving a voltage and a dielectric layer for forming a space between the upper and lower electrode layers. A plurality of perforated holes are formed in the upper and lower electrode layers and the dielectric layer. The upper and lower electrode layers are formed in a flat plate shape except for the perforated holes and are integrally formed. If a predetermined voltage is supplied across the upper and lower electrodes, a surface discharge is generated between the two electrode layers in the perforated holes. If the perforated holes are of an adequate size, a stable and efficient plasma discharge can be generated in the perforated holes.

When the discharge is generated, light is emitted from the perforated holes. In general, phosphor layers for increasing emission efficiency are formed in the perforated holes and Micro Discharges (MDs) operate in a specific gas atmosphere. Such an MD is a surface light source and can be used as a backlight source of non-self-luminous display, such as a Liquid Crystal Display (LCD).

However, the MD having the configuration described above has the same shape as that of a typical capacitor having a dielectric inserted between two electrodes. Accordingly, when an AC voltage is supplied across the two electrode layers, power may be unnecessarily consumed due to parasitic capacitance.

Since a stable and efficient plasma discharge can be generated in the perforated holes when the perforated holes are of an adequate size, and the MD described above has a shape similar to that of an initial matrix plasma display, a plasma display using an MD structure may be tried to be manufactured.

SUMMARY OF THE INVENTION

An object of the present invention is to provide a Plasma Display Panel (PDP) having a Micro Discharge (MD) structure, which can increase an aperture ratio and a viewing angle.

Another object of the present invention is to provide a Plasma Display Panel (PDP) having a Micro Discharge (MD) structure, which can prevent a phosphor layer from deteriorating while generating a face discharge.

Another object of the present invention is to provide a Plasma Display Panel (PDP) having a Micro Discharge (MD) structure, which can increase nominal contrast.

According to an aspect of the present invention, a Plasma Display Panel (PDP) is provided including: a dielectric layer having a plurality of dielectric-layer perforated holes arranged in a matrix; upper and lower electrode layers each having electrode-layer perforated holes connected to the dielectric-layer perforated holes and arranged on both surfaces of the dielectric layer, the upper and lower electrode layers being adapted to receive electrical signals; the upper electrode layer includes a plurality of upper electrodes extending in a first direction, each of the plurality of upper electrodes surrounding a group of the electrode-layer perforated holes arranged in the first direction and including transparent individual electrodes surrounding the electrode-layer perforated holes and linear connection portions adapted to electrically connect the individual electrodes; and the lower electrode layer includes a plurality of lower electrodes extending in a second direction at an angle with respect to the first direction, each of the plurality of second electrodes surrounding a group of electrode-layer perforated holes arranged in the second direction.

The dielectric-layer perforated holes are preferably arranged in either a lattice array or a delta array.

The PDP preferably further includes: upper and lower substrates arranged external to the upper and lower electrode layers, peripheries of the upper and lower substrates adapted to hermetically seal a space between the upper and lower substrates; and a discharge gas contained within the space between the upper and lower substrates.

The PDP preferably further includes a phosphor layer arranged on at least portions of surfaces of the dielectric-layer perforated holes and surfaces of the electrode-layer perforated holes.

A diameter of the dielectric-layer perforated holes is preferably greater than that of the electrode-layer perforated holes such that at least portions of the upper and lower electrode layers protrude from inner surfaces of the dielectric-layer perforated holes toward centers of the dielectric-layer perforated holes.

The PDP preferably further includes a phosphor layer arranged only on inner surfaces of the electrode-layer perforated holes of the lower electrode layers and inner surfaces of the substrates facing the electrode-layer perforated holes.

Each of the connection portions preferably includes a metal and includes looped curves surrounding outer surfaces of individual electrodes and a linear portion adapted to connect the looped curves. Each of the connection portions preferably includes a metal and includes contact portions surrounding left or right semicircles of individual electrodes and a linear portion adapted to connect both ends of the contact portions and to connect individual electrodes.

According to another aspect of the present invention, a Plasma Display Panel (PDP) is provided including: a dielectric layer having a plurality of dielectric-layer perforated holes arranged in a matrix; upper and lower electrode layers having electrode-layer perforated holes connected to the dielectric-layer perforated holes and arranged on both surfaces of the dielectric layer, the upper and lower electrode layers being adapted to receive electrical signals; the upper electrode layer includes a plurality of upper electrodes extending in a first direction, the plurality of upper electrodes surrounding a group of electrode-layer perforated holes arranged in the first direction; the lower electrode layer includes a plurality of lower electrodes extending in a second direction at an angle with respect to the first direction, the plurality of second electrodes surrounding a group of electrode-layer perforated holes arranged in the second direction; and a transmissivity adjusting layer is arranged on at least a portion of an outside of the dielectric-layer perforated holes as viewed from an upper side of the PDP.

The transmissivity adjusting layer preferably includes either a layer adapted to prevent reflection or a layer adapted to absorb or scatter external light. The transmissivity adjusting layer is preferably arranged on at least one of outer and inner surfaces of the upper substrate, inside of the upper substrate, and an upper surface of the dielectric layer not overlapping the upper electrode layer.

At least one of the upper electrodes and the lower electrodes preferably include individual electrodes surrounding the electrode-layer perforated holes and a connection portion adapted to connect the individual electrodes.

The dielectric-layer perforated holes are preferably arranged in either a lattice array or a delta array.

The PDP preferably further includes: upper and lower substrates arranged external to the upper and lower electrode layers, the peripheries of the upper and lower substrates adapted to hermetically seal a space between the upper and lower substrates; and a discharge gas contained within the space between the upper and lower substrates.

The PDP preferably further includes a phosphor layer arranged in at least portions of the perforated holes.

A diameter of the dielectric-layer perforated holes is preferably greater than that of the electrode-layer perforated holes such that at least portions of the upper and lower electrode layers protrude from inner surfaces of the dielectric-layer perforated holes toward centers of the dielectric-layer perforated holes.

The PDP preferably further includes a phosphor layer arranged only on inner surfaces of the electrode-layer perforated holes of at least one of the upper and lower electrode layers and inner surfaces of the substrates facing the electrode-layer perforated holes.

The phosphor layer arranged on the substrate preferably forms a visible screen and preferably includes a transparent phosphor layer.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
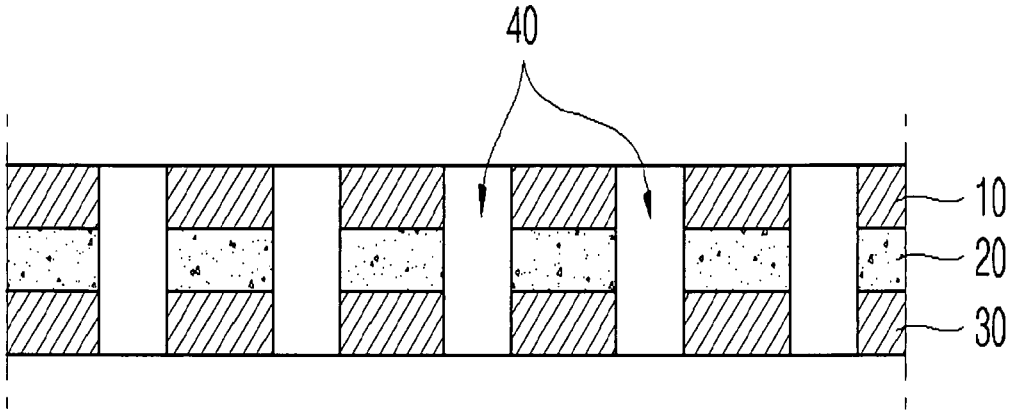
FIG. 1 CONVENTIONAL ART
FIG. 1 is a side cross-sectional view of a Micro Discharge Plasma Display Panel (MD PDP)

FIG. 1 is a side cross-sectional view of a Micro Discharge Plasma Display Panel (MD PDP).

There are various types of MD PDPs, but FIG. 1 illustrates an open MD PDP. The MD PDP is composed of three layers: upper and lower electrode layers 10 and 30 for receiving a voltage and a dielectric layer 20 for forming a space between the upper and lower electrode layers 10 and 30. A plurality of perforated holes 40 are formed in the upper and lower electrode layers 10 and 30 and the dielectric layer 20. The upper and lower electrode layers are formed in a flat plate shape except for the perforated holes 40 and are integrally formed. If a predetermined voltage is supplied across the upper and lower electrodes, a surface discharge is generated between the two electrode layers in the perforated holes. If the perforated holes are of an adequate size, a stable and efficient plasma discharge can be generated in the perforated holes.

When the discharge is generated, light is emitted from the perforated holes. In general, phosphor layers for increasing emission efficiency are formed in the perforated holes and Micro Discharges (MDs) operate in a specific gas atmosphere. Such an MD is a surface light source and can be used as a backlight source of non-self-luminous display, such as a Liquid Crystal Display (LCD).

However, the MD having the configuration of FIG. 1 has the same shape as that of a typical capacitor having a dielectric inserted between two electrodes. Accordingly, when an AC voltage is supplied across the two electrode layers, power may be unnecessarily consumed due to parasitic capacitance.

Since a stable and efficient plasma discharge can be generated in the perforated holes when the perforated holes are of an adequate size, and the MD of FIG. 1 has a shape similar to that of an initial matrix plasma display, a plasma display using an MD structure may be tried to be manufactured.

Hereinafter, exemplary embodiments of the present invention are described in detail with reference to accompanying drawings.

Figure 2:
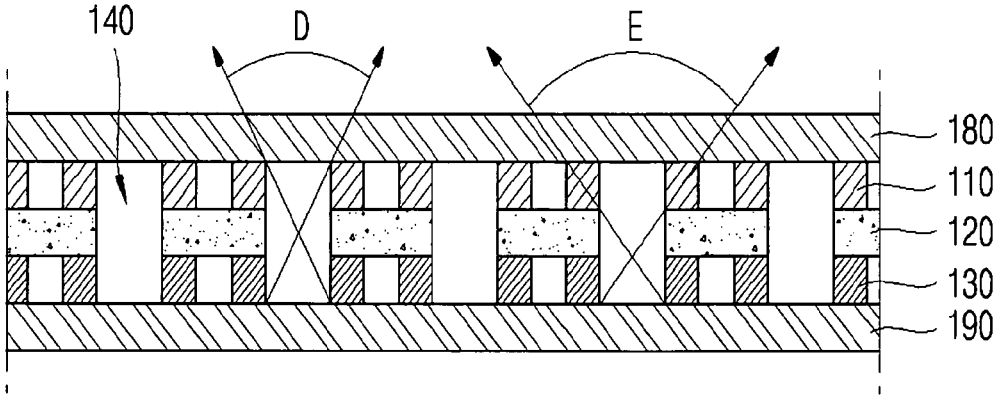
FIG. 2 is a side cross-sectional view of an MD PDP according to an embodiment of the present invention.

FIG. 2 is a side cross-sectional view of a PDP according to an embodiment of the present invention.

Figure 3:
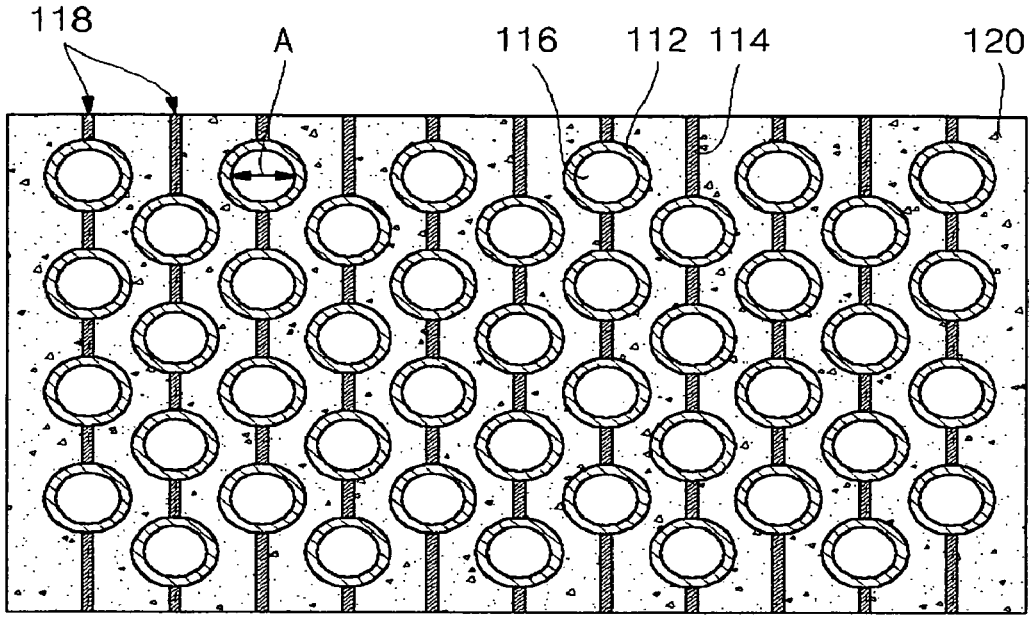
FIGS. 3 through 5 are respective plan views of an upper electrode layer, a lower electrode layer, and a dielectric layer of the MD PDP according to the embodiment of the present invention.
Figure 4:
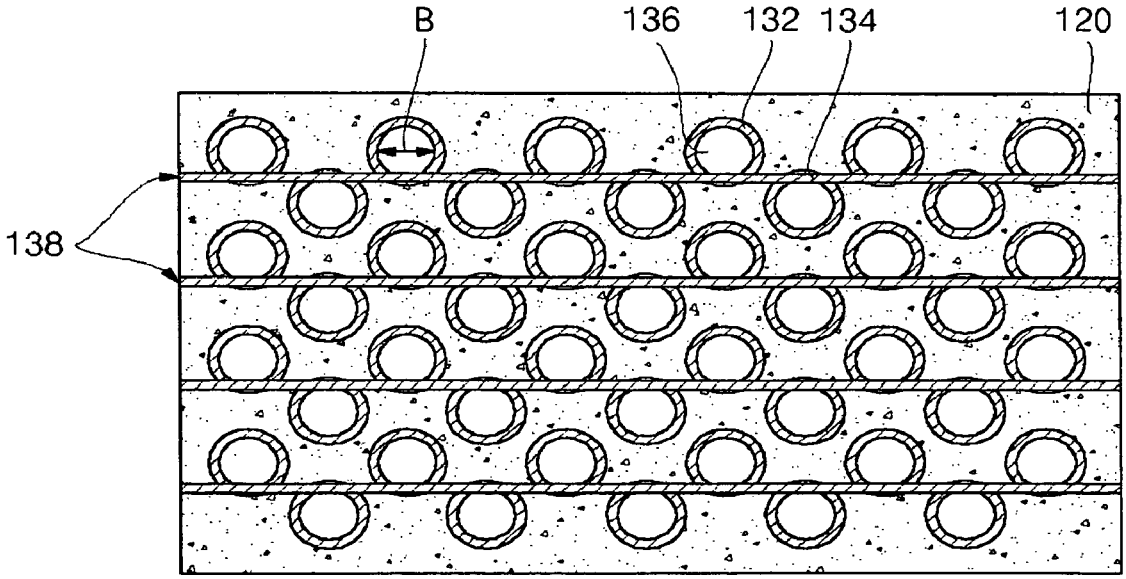
Figure 5:
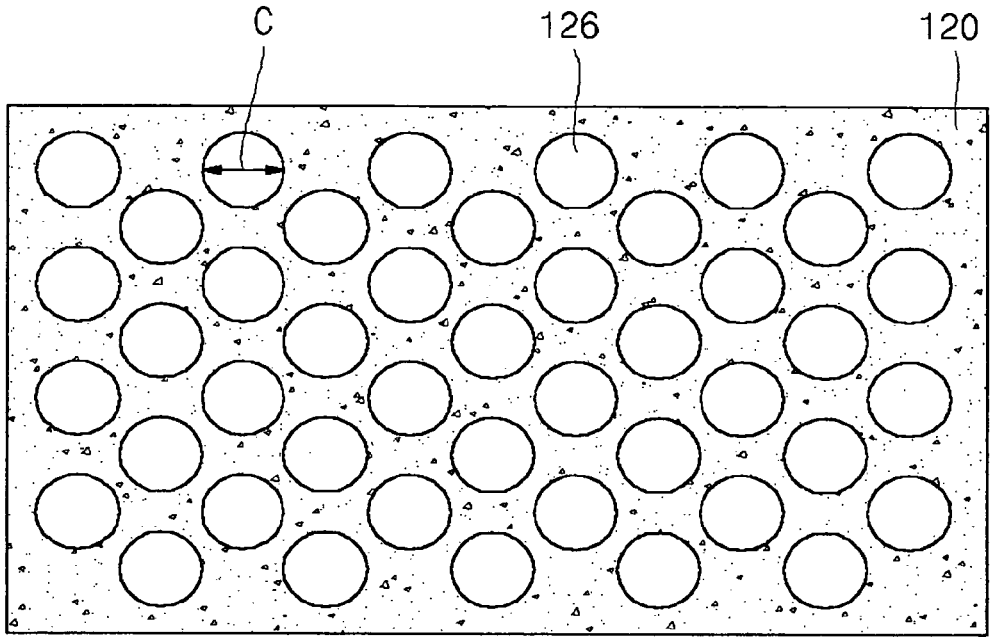

FIGS. 3 through 5 are respective plan views of an upper electrode layer, a lower electrode layer, and a dielectric layer of the PDP according to the embodiment of the present invention.

First, in order to reduce parasitic capacitance, electrode portions except for the peripheries of the perforated holes are removed from the MD structure of FIG. 1. In other words, individual electrodes 112 surrounding perforated holes 140 and connection portions for supplying a voltage to the individual electrodes 112 form a matrix plasma display.

As shown in FIG. 3, the connection portions 114 of an upper electrode layer 110 extend in a horizontal or vertical direction to form a group of first electrodes 118. As shown in FIG. 4, the connection portions 134 of a lower electrode layer 130 extend in a direction perpendicular to the first electrode to form a group of second electrodes 138.

As shown in FIG. 3, in a plurality of first electrodes 118, the individual electrodes 112 surrounding electrode-layer perforated holes 116 are made of a transparent material and the connection portions 114 for connecting the individual electrodes 112 are made of metal such that the connection portions 114 perform a bus function.

In order to form perforated holes 126 of a dielectric layer 120 in a delta array, each second electrode 138 includes a linear connection portion 134 which extends in a horizontal direction and individual electrodes 132 surrounding the perforated holes 136 which are arranged in a zigzag shape at the upper and lower sides of the linear connection portion 134. The second electrodes 138 extend in the horizontal direction and the electrode-layer perforated-holes 136 formed in the second electrodes are included in a group of perforated holes arranged in the horizontal direction. The second electrodes 138 need not be formed of a transparent material because the second electrodes 138 are positioned on the side for emitting visible light generated by the perforated holes.

The first electrodes 118 are referred to as address electrodes which are connected to the terminals of an address electrode driver, and the second electrodes 138 are referred to as scan electrodes which are connected to the terminals of a scan electrode driver. When a negative voltage is supplied to a first scan electrode located at an uppermost side of FIG. 4, and a positive voltage is supplied to a first address electrode located at a leftmost side and a third address electrode of FIG. 3, a discharge is generated by a potential difference therebetween in first and second perforated holes in a first row.

Thereafter, when a voltage is supplied to the address electrodes depending on a display portion while voltages are sequentially supplied to second and third scan electrodes, a discharge is generated in the perforated holes. When all of the perforated holes are scanned in this manner, an image can be displayed by an afterimage effect depending on the discharge of each perforated hole.

In FIG. 2, substrates 180 and 190 which are provided at the outside of the upper and lower electrode layers, that is, the upper side of the upper electrode layer 110 and the lower side of the lower electrode layer 130, hermetically seal the volume inside of the substrates. The peripheries of the substrates 180 and 190 are sealed. The volume inside of the substrates forming a discharge space is sealed except for an ejection port (not shown), air in the discharge space is removed, and a discharge gas is injected into the discharge space with an adequate pressure. Subsequently, the ejection port is sealed. Accordingly, when a voltage is supplied, the electrodes can be prevented from being oxidized by oxygen in air and thus prevented from deteriorating. Furthermore, the discharge gas can be used for increasing discharge efficiency and evaporation of the electrode.

Referring to FIGS. 2 and 3, if the individual electrodes 112 of the upper electrode layer 110 are positioned at the side (upper side) forming a visible screen, the individual electrodes 112 are made of a transparent material, such as Indium-Tin-Oxide (ITO), Indium-Zinc-Oxide (IZO), or Indium-Tin-Zinc-Oxide (ITZO) such that light can be emitted through the transparent electrodes. Accordingly, as can be indicated by arrows, a viewing angle E of the present embodiment is wider than a viewing angle D of PDPs having an opaque electrode. It is assumed that the discharge is generated at all the perforated holes 140 to emit the visible light.

Figure 6:
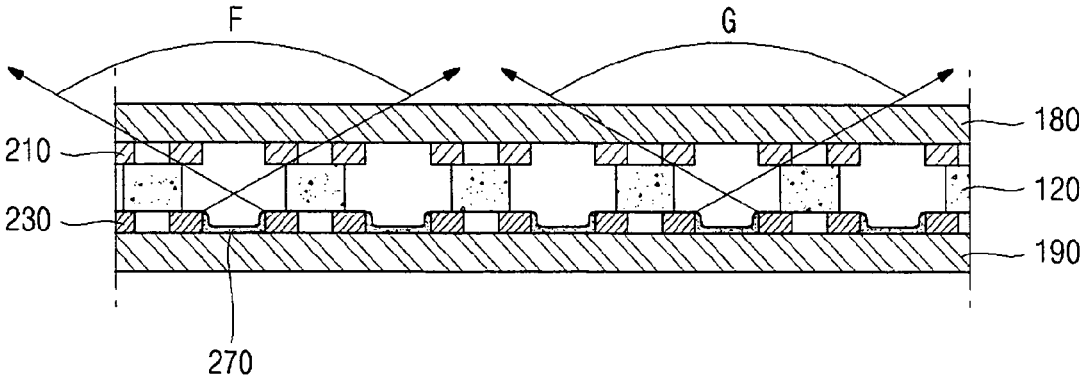
FIG. 6 is a side cross-sectional view of an MD PDP according to another embodiment of the present invention.

FIG. 6 is a side cross-sectional view of a PDP according to another embodiment of the present invention.

The configurations of upper and lower electrode layers 210 and 230, a dielectric layer 120, perforated holes, and substrates are the same as those of FIG. 2 except for the position and size of the individual electrodes. A phosphor layer 270 (not shown in FIG. 2) is formed. When the phosphor layer is formed, a color display is improved and the discharge efficiency increases, as compared to a PDP emitting light using only the discharge gas.

Referring to FIGS. 3 through 6, when the size C of the perforated hole (dielectric-layer perforated hole) of the dielectric layer 120 is larger than at least one of the sizes A (FIG. 3) and B (FIG. 4) of the perforated holes (electrode-layer perforated holes) of the upper and lower individual electrodes 112 and 132 of the upper and lower electrode layers 210 and 230, the individual electrodes 112 and 132 partially protrude from the dielectric layer 120 toward the center of the perforated holes and thus the upper and lower individual electrodes 112 and 132 face each other. When a voltage is supplied across the upper and lower electrode layers 210 and 230, a facing discharge is generated. When the facing discharge is generated, a discharge can be generated between the upper and lower electrode layers by a potential difference lower than that of a PDP where the electrodes spaced apart from each other at the same interval generate the surface discharge. Thus, the discharge efficiency can be improved.

Even in the present embodiment, the upper substrate 180 and the lower substrate 190 are provided in addition to the basic three-layer structure of the MD PDP, such that the PDP has durability. The space between the substrates is hermetically sealed by sealing the peripheries of the substrates, and air containing oxygen in the perforated holes is removed, and a discharge gas is injected into the space.

The ends of perforated holes formed in the dielectric layer 120 and the upper and lower electrodes 210 and 230 are blocked by the substrates 180 and 190 to form a discharge cell space. In the discharge cell of FIG. 6, the phosphor layer 270 is formed on the lower substrate 190 to cover the side surfaces of the individual electrodes facing the perforated holes. The phosphor layer 270 is formed to cover the inner surface of the lower substrate 190, in addition to the side surface of the lower electrode layer 230.

The emitted externally visible light is mainly emitted from the phosphor layer and the light is emitted through the transparent electrodes. Therefore, as indicated by the arrows, a viewing angle G of the present embodiment is wider than a viewing angle F of PDPs having opaque electrodes.

Although not shown, a phosphor layer can also formed on the upper substrate 180. If the upper substrate forms a visible screen of the display, the light can be emitted well through the phosphor layer laminated on the upper substrate. Therefore, the phosphor covered on the inner surface of the upper substrate is preferably transparent.

When laminating the phosphor, the phosphor is not laminated to the facing surfaces of the upper and lower individual electrodes and thus the phosphor can be prevented from deteriorating when the facing discharge is generated. In addition, it is possible to prevent a discharge voltage from being affected by the characteristics of the phosphor, that is, the permittivity of each color of the phosphor.

In order to form the phosphor having the above-mentioned structure, a method of forming an electrode pattern having perforated holes on the substrate and laminating the phosphor in each perforated hole using a printing method can be considered. In consideration of the stepped structure of the substrate on which the phosphor layer is formed, an inkjet ejecting method can easily apply to the present embodiment, rather than photolithography.

Figure 7:
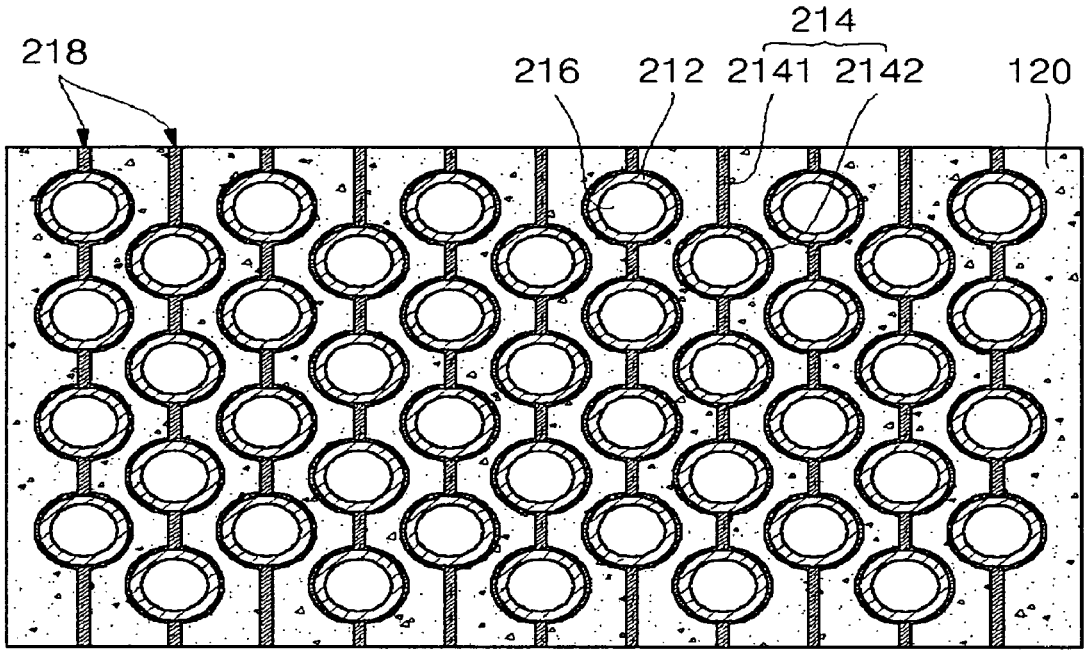
FIGS. 7 and 8 are plan views of an upper electrode layer according to other embodiments of the present invention.
Figure 8:
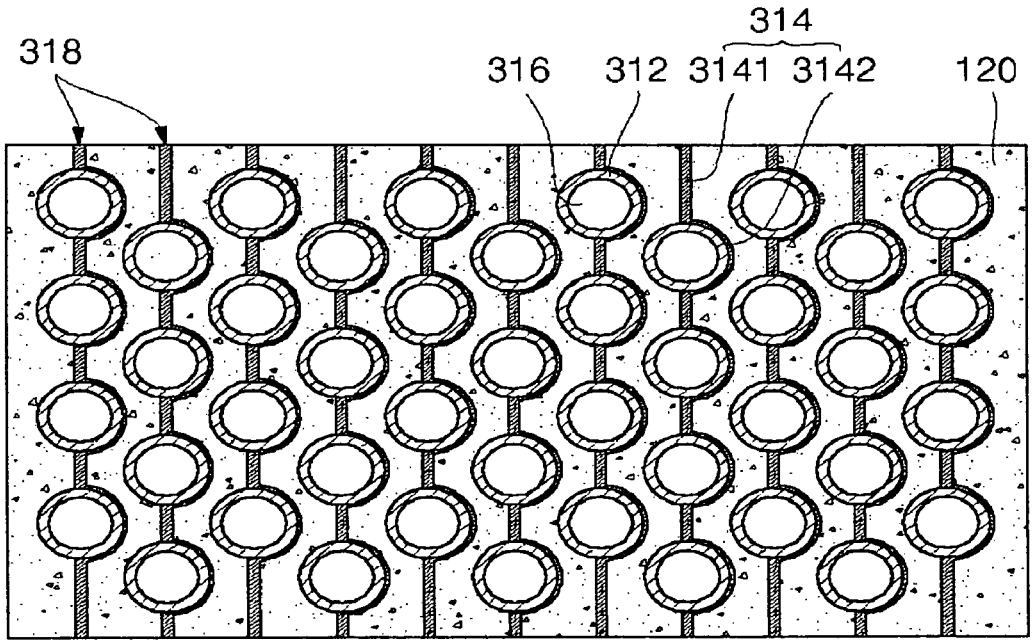

FIGS. 7 and 8 are plan views of an upper electrode layer according to other embodiments of the present invention.

In FIG. 7, individual electrodes 212 surrounding the electrode-layer perforated holes 216 are made of a transparent material and each of the connection portions 214 includes looped curves 2142 surrounding the outer surfaces of the individual electrodes 212 and a linear portion 2141 for electrically connecting the individual electrodes 212 in one direction. The connection portions 214 are made of an opaque metal having a resistance value lower than that of the transparent material.

In FIG. 8, the individual electrodes 312 surrounding the electrode-layer perforated holes 316 are made of a transparent material and connection portions 314 are made of metal. Each of the connection portions 314 includes contact portions 3142 surrounding the left or right semicircles of the individual electrodes and a linear portion 3141 for connecting the upper and lower ends of the contact portions and connecting adjacent individual electrodes arranged in a vertical direction.

In the embodiments of FIGS. 7 and 8, the resistance values of the individual electrodes 212 and 312 made of the transparent material is much higher than that of metal. Accordingly, if all of the individual electrodes are made of the transparent material, a voltage drop and signal distortion is apt to be generated. Thus, in the above-mentioned embodiments, the metal connection portions 214 and 314 serve to connect the transparent individual electrodes and function as bus electrodes for supplying an electrical signal to the transparent individual electrodes. Since the metal electrodes surrounding the individual electrodes are positioned on the outer surfaces of the individual electrodes and can be formed to be thin due to a low resistance value, the metal electrodes do not block the light when the light emitted from the perforated holes passes through the transparent electrodes.

In addition, the connection portions can be of the same shape as those of FIG. 4.

Figure 9:
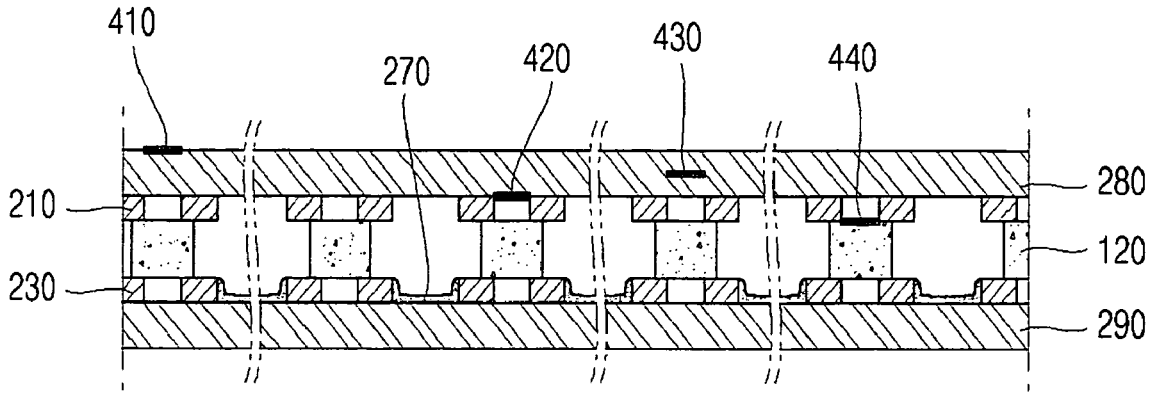
FIG. 9 is a cross-sectional view of embodiments of the present invention.

FIG. 9 is a cross-sectional view of embodiments of the present invention.

The configurations of a lower substrate 290, electrode layers 210 and 230, a dielectric layer 120, and a phosphor layer 270 are the same as those of FIG. 6. Transmissivity adjusting layers 410, 420, and 430 can be formed on or in the upper substrate 280 forming the visible screen in three configurations. A transmissivity adjusting layer 440 is formed on the dielectric layer 120 in the upper electrode layer 210. The transmissivity adjusting layer can be formed in the substrate by forming a material layer or adjusting the transmissivity of a desired region.

The transmissivity adjusting layer serves to prevent external light from being reflected and to allow the light emitted from the PDP to be viewed at the front side thereof.

Accordingly, since the reflected external light except for the light emitted from the discharge space of the PDP can be reduced even when viewing the PDP in a bright environment, it is possible to increase nominal contrast and provide a screen having high-definition and high image quality.

In order to form the structure of FIG. 2, 6, or 7, various methods can be used. For example, there is a method of forming upper and lower electrode layers on upper and lower substrates, inserting, aligning, and laminating a dielectric layer therebetween, and sealing the peripheries of the substrates. Alternatively, there is also a method of separating forming substrates, upper and lower electrode layers, and a dielectric layer and then aligning and laminating the substrates and the layers in an adequate order, and sealing the peripheries of the substrates. A manufacturing method, a laminated material, the connection between electrodes and driving circuits, a circuit configuration are widely known to those skilled in the art and accordingly, a detailed discussion thereof has been omitted.

According to the present invention, it is possible to provide a PDP having stable characteristics and efficiency of an MD.

Furthermore, according to the present invention, it is possible to provide a reliable PDP having a simple structure.

While the present invention has been particularly shown and described with reference to exemplary embodiments thereof, it will be understood by those skilled in the art that various modifications in form and detail can be made therein without departing from the spirit and scope of the present invention as defined by the appended claims.

What is claimed is:

1. A Plasma Display Panel (PDP), comprising:

a dielectric layer having a plurality of dielectric-layer perforated holes;

an upper electrode layer having electrode-layer perforated holes connected to the dielectric-layer perforated holes and arranged on an upper surface of the dielectric layer, the upper electrode comprising a plurality of upper electrodes extending in a first direction, each of the upper electrodes comprising:

a plurality of transparent individual circular electrodes each surrounding at least one of the electrode-layer perforated holes of the upper electrode layer; and a connection portion to electrically connect one of the transparent individual circular electrodes to another of the transparent individual circular electrodes;

a lower electrode layer having electrode-layer perforated holes connected to the dielectric-layer perforated holes and arranged on a lower surface of the dielectric layer, the lower electrode layer comprising a plurality of lower electrodes extending in a second direction, each of the lower electrodes comprising a plurality of individual circular electrodes each surrounding at least one of the electrode-layer perforated holes of the lower electrode layer; and a phosphor layer arranged on a portion of a surface of one of the electrode-layer perforated holes of the lower electrode layer.

2. The PDP according to claim 1, wherein the dielectric-layer perforated holes are arranged in either a lattice array or a delta array.

3. The PDP according to claim 1, further comprising:

upper and lower substrates arranged external to the upper and lower electrode layers, peripheries of the upper and lower substrates to hermetically seal a space between the upper and lower substrates; and a discharge gas contained within the space between the upper and lower substrates.

4. The PDP according to claim 1, wherein the phosphor layer is arranged on portions of surfaces of the dielectric-layer perforated holes.

5. The PDP according to claim 3, wherein the phosphor layer is arranged on an inner surface of the lower substrate.

6. The PDP according to claim 3, wherein a diameter of the dielectric-layer perforated holes is greater than that of the electrode-layer perforated holes of each of the upper and lower electrode layers such that at least portions of the upper and lower electrode layers protrude from inner surfaces of the dielectric-layer perforated holes toward centers of the dielectric-layer perforated holes.

7. The PDP according to claim 3, wherein the phosphor layer is arranged on an inner surface of the lower substrate facing the electrode-layer perforated holes of the lower electrode layer.

8. The PDP according to claim 1, wherein the connection portion comprises a looped curve surrounding an outer surface of the one of the transparent individual circular electrodes and a linear portion to connect the looped curve to the another of the transparent individual circular electrodes, the connection portion being formed of a metal.

9. The PDP according to claim 1, wherein the connection portion comprises a contact portion surrounding about a half of a perimeter of the one of the transparent individual circular electrodes and a linear portion to connect the contact portion to the another of the transparent individual circular electrodes, the contact portion being formed of a metal.

10. A Plasma Display Panel (PDP), comprising:

a dielectric layer having a plurality of dielectric-layer perforated holes;

an upper electrode layer having electrode-layer perforated holes connected to the dielectric-layer perforated holes and arranged on an upper surface of the dielectric layer, the upper electrode comprising a plurality of upper electrodes extending in a first direction, each of the upper electrodes comprising a plurality of individual circular electrodes each surrounding at least one of the electrode-layer perforated holes of the upper electrode layer;

a lower electrode layer having electrode-layer perforated holes connected to the dielectric-layer perforated holes and arranged on a lower surface of the dielectric layer, the lower electrode layer comprising a plurality of lower electrodes extending in a second direction, each of the lower electrodes comprising a plurality of individual circular electrodes each surrounding at least one of the electrode-layer perforated holes of the lower electrode layer; and a transmissivity adjusting layer for preventing external light from entering the PDP, the transmissivity adjusting layer being formed not to overlap with the dielectric-layer perforated holes; and a phosphor layer arranged on a portion of a surface of one of the electrode layer perforated holes of the lower electrode layer.

11. The PDP according to claim 10, wherein the transmissivity adjusting layer comprises either a layer to prevent reflection or a layer to absorb or scatter external light.

12. The PDP according to claim 10, further comprising:

an upper substrate disposed on the upper surface of the upper electrode layer; and a lower substrate disposed on a lower surface of the lower electrode layer, wherein the transmissivity adjusting layer is arranged on an upper surface of the upper substrate, on a lower surface of the upper substrate, or inside the upper substrate.

13. The PDP according to claim 10, wherein at least one of the upper electrodes and the lower electrodes comprises a connection portion to electrically connect two of the individual circular electrodes of the upper electrodes or two of the individual circular electrodes of the lower electrodes.

14. The PDP according to claim 10, wherein the dielectric-layer perforated holes are arranged in either a lattice array or a delta array.

15. The PDP according to claim 10, further comprising:

upper and lower substrates arranged external to the upper and lower electrode layers, the peripheries of the upper and lower substrates to hermetically seal a space between the upper and lower substrates; and a discharge gas contained within the space between the upper and lower substrates.

16. The PDP according to claim 15, wherein a diameter of the dielectric-layer perforated holes is greater than that of the electrode-layer perforated holes of each of the upper and lower electrode layers such that at least portions of the upper and lower electrode layers protrude from inner surfaces of the dielectric-layer perforated holes toward centers of the dielectric-layer perforated holes.

17. The PDP according to claim 10, wherein the phosphor layer is arranged on an inner surface of the lower substrate facing the electrode-layer perforated holes.

18. The PDP according to claim 17, wherein the phosphor layer arranged on the substrate forms a visible screen and comprises a transparent phosphor layer.

* * * * *